US005199621A

United States Patent [19]

McLennan

[11] Patent Number: 5,199,621

[45] Date of Patent: Apr. 6, 1993

[54] DRUMSTICK HOLDER HOLSTER

[76] Inventor: Stephen J. McLennan, 2236 Albury Ave., Long Beach, Calif. 90815

[21] Appl. No.: 667,277

[22] Filed: Mar. 11, 1991

[51] Int. Cl.[5] ..... A45F 5/00; A45F 3/00

[52] U.S. Cl. ..... 224/253; 224/910; 224/223; 224/224

[58] Field of Search ..... 224/910, 223, 224, 247, 224/251, 904, 227, 253, 916; 84/329, 422.4, 453, 421; 248/314, 315; 211/60.1

[56] References Cited

U.S. PATENT DOCUMENTS

| | | | |
|---|---|---|---|
| 2,264,481 | 12/1941 | Peterson | 224/223 |
| 2,575,126 | 11/1951 | Ramsey | 224/916 |
| 2,715,990 | 8/1955 | Austin | 224/916 |
| 3,088,583 | 5/1963 | Holtz | 224/916 |
| 3,365,108 | 1/1968 | Giba | 224/910 |
| 3,766,954 | 10/1973 | Gentellalli | 224/916 |
| 4,523,702 | 6/1985 | Viio | 224/101 |

*Primary Examiner*—Henry J. Recla
*Assistant Examiner*—David J. Walozak
*Attorney, Agent, or Firm*—Walter Unterberg

[57] ABSTRACT

The holster stores a number of drumsticks—or mallets or other rigid beaters of percussion instruments—for instant and speedy withdrawal by a percussion player during performance if a drumstick needs to be suddenly replaced or added. The holster is a trapezoidal plate, typically of leather, provided with two rows of elastic loops, each row having the same number of identical loops. One row is formed along the long parallel side with wide loop spacing, and the other row along the short parallel side with close loop spacing. Each stored drumstick is inserted through two corresponding opposed loops, one in each row, with the striking end of the drumstick near a close spaced loop. The differential loop spacing between the rows causes the stored drumsticks to radiate out holding end first, and also deforms all loops to grip the drumsticks. The radiating out also causes the drumstick holding ends to be well spread apart for convenient withdrawal of a given drumstick without disturbing its neighbors. Withdrawal by hand easily overcomes the gripping action of the loops. The holster can be attached to any suitable body part—hips, thigh, leg, arm, etc.—by body straps, typically of nylon. Also, the holster can be ornamented and carry any desired insignia. Several holsters can be used in combination.

11 Claims, 4 Drawing Sheets

VIEW A—A

FIGURE 5
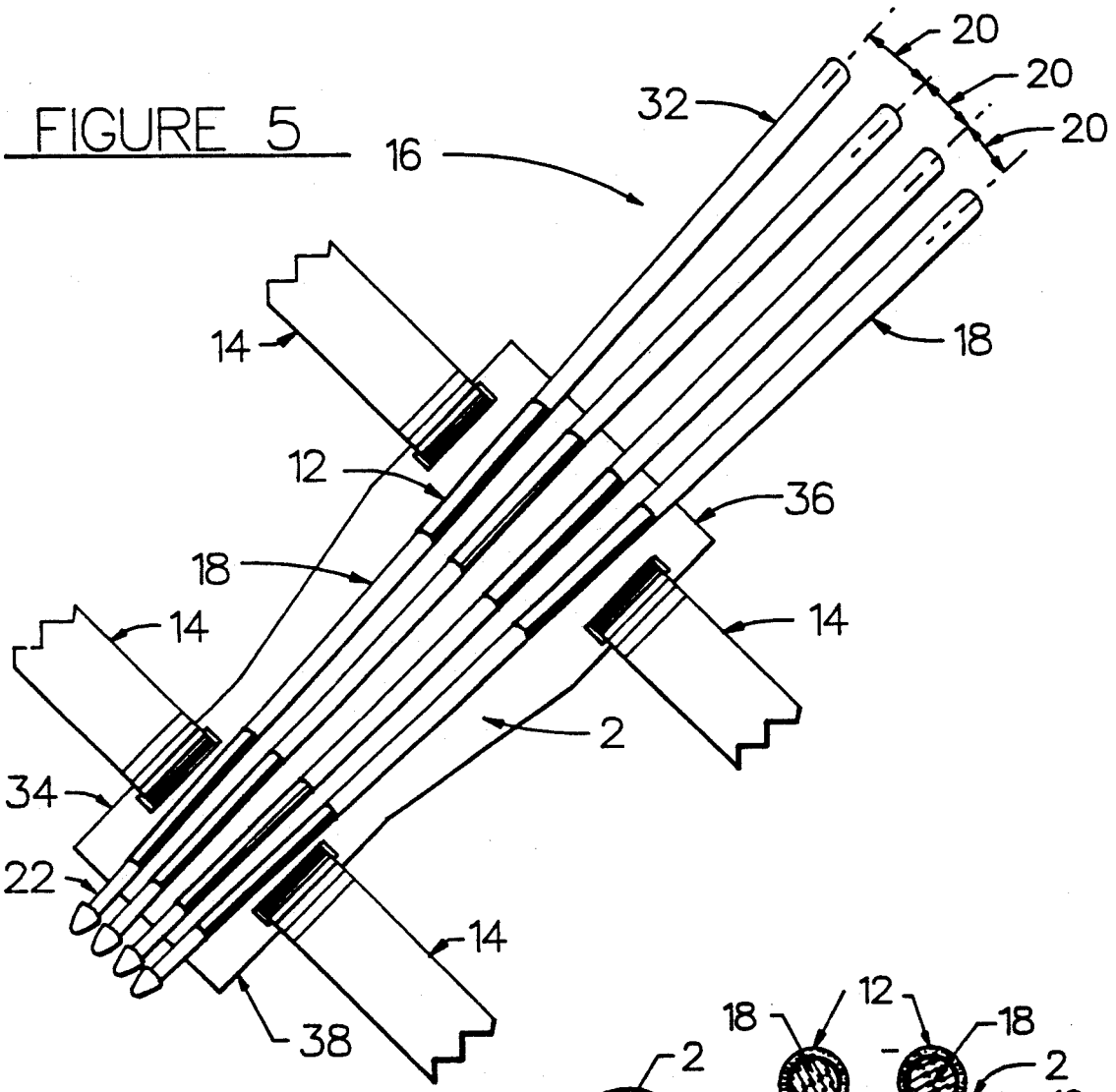
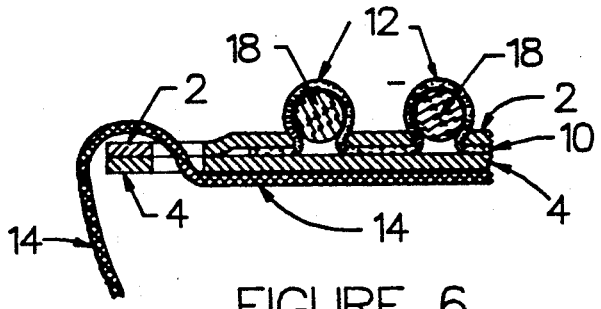
FIGURE 6

DRUMSTICK HOLDER HOLSTER

BACKGROUND OF THE INVENTION

1. Field of the Invention

This invention relates to storage devices for drumsticks and similar beaters for percussion instruments used by percussion players. More specifically, it relates to such storage devices which are attached to the player's body with easy access to the drumsticks during performance.

2. Description of Related Art

Percussion players in bands, orchestras, jazz groups, pop groups or rock groups may perform seated, standing or marching. In all these positions they frequently lose the use of drumsticks and other beaters of percussion instruments while performing due to a number of reasons: the drumstick may slip out of the player's hand; the drumstick may break in two; or, a piece may chip off the tip of the drumstick. In such eventualities the player needs immediately to replace the drumstick, missing as few beats as possible. An easy access to a replacement displacement is needed. A similar situation arises when the player needs to add a beater such as a mallet when playing marimba or xylophone where two mallets per hand may be required after starting out with one mallet per hand.

Existing drumstick storage devices are of several types: a tubular vertical drumstick holder, like a quiver, mounted to a floor stand; a bag mounted to the player's seat or to the perimeter of a drum with a horizontal skin; or mounting holes in the percussion player's 'throne'.

None of these devices bring stored drumsticks close enough to the player to permit him to quickly grab a replacement drumstick during a performance. A search in the patent literature disclosed related storage devices for elongated articles. Freid (U.S. Pat. No. 2,746,658) shows an arm-mounted quiver for arrows which can be removed from the quiver by the other hand. Schoenike (U.S. Pat. No. 2,464,101) describes a quiver for arrows where the arrows are stored in a multi-pocket flexible structure, with laces to attach the quiver to "the person of the user". Similar devices are the cartridge pocket of Fisher (U.S. Pat. No. 900,003) and the carrier for small arms fixed ammunition of Mills (U.S. Pat. No. 722,124). It is to be noted that the devices of all these inventors show the arrows or cartridges mounted in parallel arrays in close proximity to each other. This makes the rapid extraction of one article while the other articles are still in storage a matter of manual dexterity. Further, no specific suggestions are made how or to what body part these storage containers are to be attached (except in the case of Freid). Moreover, the arrows or cartridges have parallel surfaces in the longitudinal direction while drumsticks and mallets generally are of variable cross-section, the tip generally of smaller cross-section than the handle, with a taper in the longitudinal (or axial) direction between handle and tip. This taper needs to be accommodated in a storage device dedicated to the rapid removal of drumsticks and the like during performance.

Consequently, the present invention, designated a drumstick holding holster, was conceived to implement the required objects as stated below.

OBJECTS OF THE INVENTION

It is an object of this invention to provide a storage device for drumsticks and similar beaters for percussion instruments such that the percussion player may conveniently grasp one of the stored drumsticks from the storage device during a performance to replace a drumstick which became lost.

It is another object to provide a drumstick storage device which may be attached to the percussion player's body at one or more suitable locations for very rapid drumstick replacement, for any playing position, be it seated, standing or marching.

It is a further object to provide a drumstick storage device which holds the drumsticks with a sufficient grip so that they do not accidentally leave the storage device, regardless of its position with respect to gravity, and yet permit the drumsticks to be withdrawn with a normal pulling force, even by a small person.

It is yet another object to provide a drumstick storage device which accommodates drumsticks of tapering cross-section.

Another object of the invention is to provide a drumstick storage device which stores the drumsticks in such a way that adequate space exists around each drumstick at its end holding or handle where it can be pulled out without interfering with adjacent stored drumsticks.

It is still another object to provide a drumstick storage device made of a flexible material which will conform to the surface of the body part to which the storage device is attached.

SUMMARY OF THE INVENTION

To implement the stated objects of the invention, a drumstick holding holster has been devised. The central holster component is a trapezoidal upper plate, typically of leather, to which are secured a number of drumsticks. The central drumstick lies along the longitudinal axis of the trapezoid, and the outer drumsticks lie along the inclined edges of the trapezoid, at an angle to the central drumstick. The intermediate drumsticks make intermediate angles with the central drumstick. The stored drumstick configuration thus is fan-shaped or radiating, with the drumsticks making a small angle with each other. The striking ends of the drumsticks are near the short parallel side of the trapezoid, and the holding ends or handles are near, and usually extending beyond, the long parallel side of the trapezoid. The fan-shaped drumstick configuration provides enough distance between the held ends of the drumsticks, so that each drumstick can be extracted from storage without interference from neighboring stored drumsticks.

The preferred embodiment to provide the fan-shaped or radiating out drumstick configuration comprises two rows of slots cut into the upper plate. One row is along the long parallel side of the trapezoidal upper plate with equally widely-spaced slots, and the other row along the short parallel side with equally closely-spaced slots. The number of slots is the same in both rows and equal to the number of drumsticks to be stored in the holster. A long flat elastic ribbon, typically of knitted material, is introduced at one end of one row of slots and threaded in and out of all slots to form loops extending upward from the slots. The same procedure is carried out for the other row of slots with a second flat elastic ribbon. A lower plate of the same trapezoidal shape and dimensions as the upper plate is glued to the upper plate and the loop-forming ribbons in place to constitute the holster assembly.

The drumsticks are now inserted with their striking ends first by pushing through the widely-spaced loops and further through the corresponding closely-spaced loops. Since corresponding loops in the two rows are offset from each other and the drumsticks are rigid, each drumstick causes the two loops around it to deform, aligning the drumstick at the desired angle with the central axis of the trapezoid. The deformation of the elastic loops provides a good grip on the drumstick by both loops. Yet, the drumstick may be pulled from the holster by use of the same axial force with which it had been pushed through the two loops to store it in the holster.

The holster assembly is also perforated by two pairs of body strap openings on each end of the rows of loops. Two flexible body straps, typically of nylon, are fed through the body strap openings and strap the holster, after it is loaded with drumsticks, to a convenient part of the player's body, such as around the hips, a thigh, a leg or an arm, in such a way that the player's hands can grasp the held ends or handles of the stored drumsticks for speedy deployment. The leather holster is flexible enough to conform to the surface of the body part to which the holster is attached. If desired, two holsters may be worn, such as one on each thigh of a player. Further, the plate may have additional area to carry ornaments and/or insignia, such as those of the performer or performing group.

BRIEF DESCRIPTION OF THE DRAWING

A better understanding of the invention may be gained by reference to the following Detailed Description in conjunction with the accompanying drawings, in which:

FIG. 5 is a plan view of the Drumstick Holding Holster with drumsticks in place;

FIG. 6 is a half-section through FIG. 5 showing the assembled upper and lower plates with ribbons, drumsticks and a body strap;

DETAILED DESCRIPTION OF THE PREFERRED EMBODIMENTS

Figure 1:
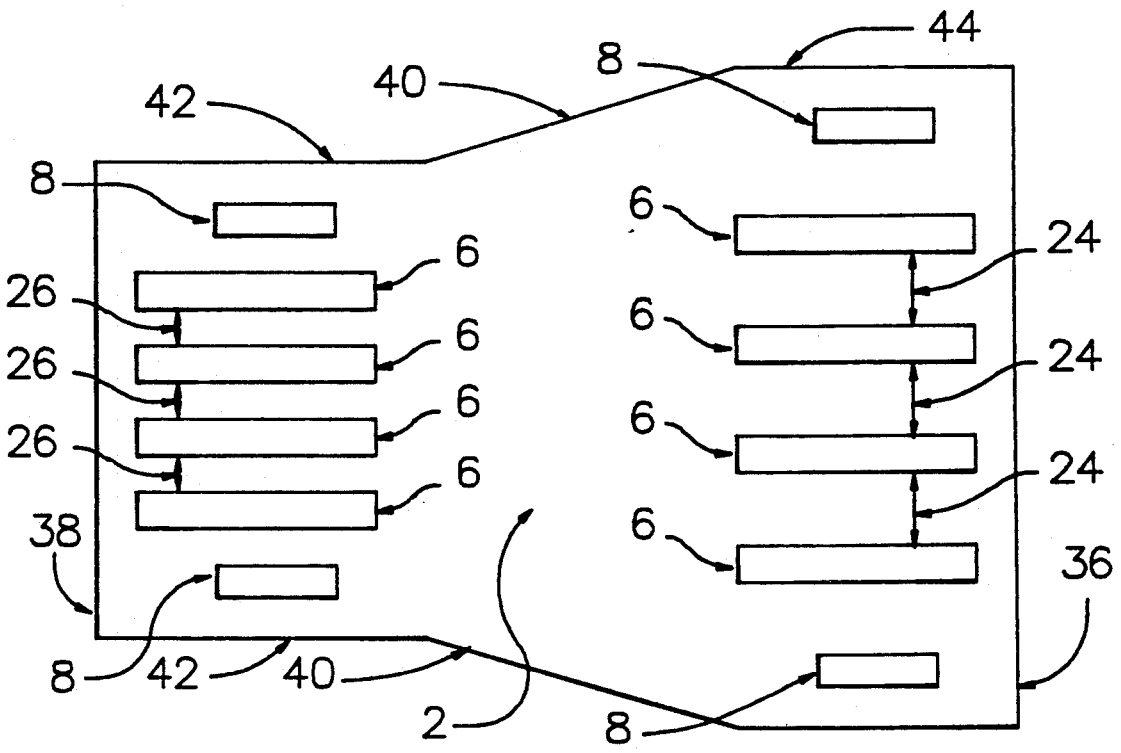
FIG. 1 is a plan view of the top plate as seen from the side on which the drumsticks are stored.

Referring to FIG. 1, the upper plate 2 made of flat stock of a moderately flexible material such as thick leather, is approximately in the shape of a trapezoid having a short parallel side 38 and a long parallel side 36 parallel to each other, connected by pairs of longitudinal edges 42, slant edges 40 and longitudinal edges 44. The small rectangle bounded by side 38 and the pair of edges 42 is perforated by a row of equally closely-spaced elongated slots 6 a distance 26 apart with their longitudinal axes perpendicular to side 38. Four slots which equals the number of drumsticks to be stored are shown on FIG. 1. The same number of slots is cut into the large rectangle bounded by side 36 and the pair of edges 44 to form a row of equally widely-spaced elongated slots 6 a distance 24 apart, with their longitudinal axes perpendicular to side 36, where distance 24 exceeds distance 26. In addition, upper plate 2 is perforated by two pairs of body strap openings 8, one pair 8 being located on each side of the row of slots 6 in the small rectangle bounded by side 38 and the pair of edges 42. The other pair 8 is located on each side of the row of slots 6 in the large rectangle bounded by side 36 and the pair of edges 44.

Figure 2:
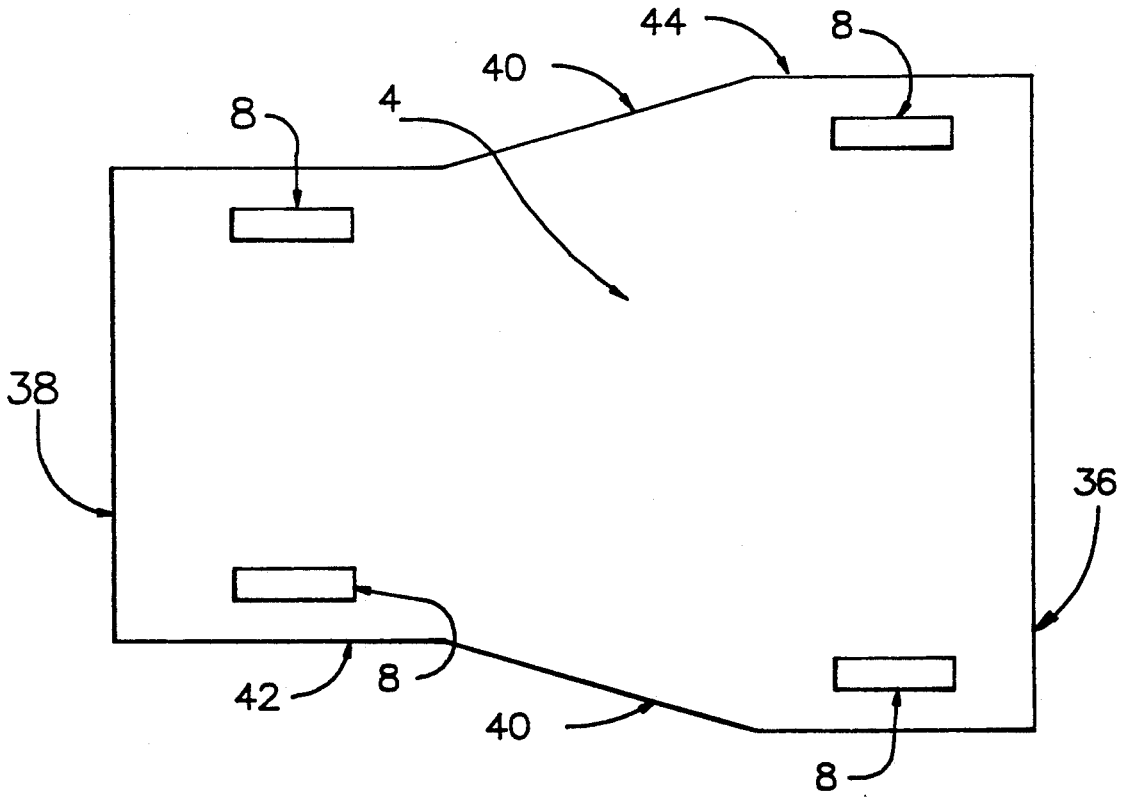
FIG. 2 is a plan view of the bottom plate as seen from the side opposite to the drumstick storage side.

Referring to FIG. 2, the lower plate 4 has the same plan view as the upper plate 2, but cut into it are only the two pairs of body strap openings 8, in the same locations as in upper plate 2. When plate 2 and plate 4 are superimposed, the four body strap openings 8 coincide, allowing body strap 14, as shown in FIG. 6, to be pulled through all openings 8 in both plates.

Figure 3:
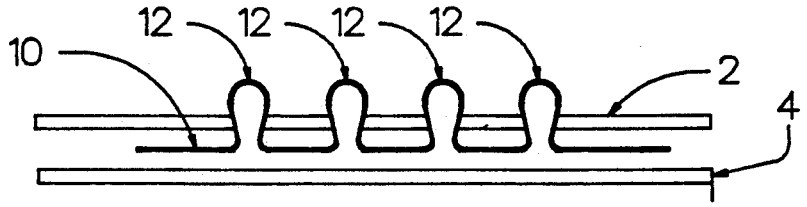
FIG. 3 is an exploded view of how the drumstick loops are formed from a single flexible ribbon-actually it is the view in direction A—A on FIG. 4.
Figure 4:
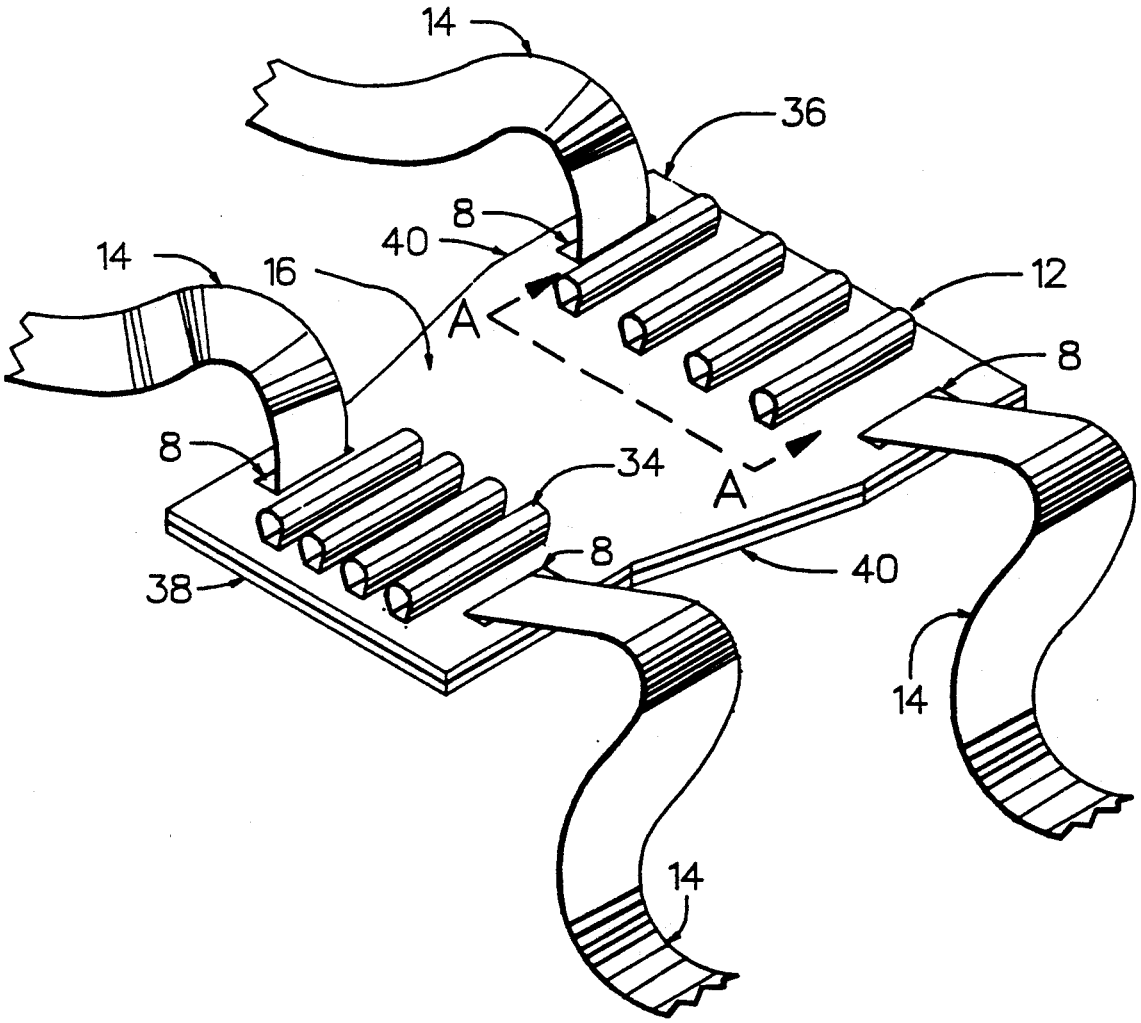
FIG. 4 is the completely assembled Drumstick Holding Holster with two rows of loops.

Referring to FIG. 3, the method of loop construction is shown. Two long flat elastic ribbons 10 are pulled through slots 6 in upper plate 2 to form in each slot of the row of equally widely-spaced slots along side 36 a loop 12, and in each slot of the row of equally closely-spaced slots along side 38 a loop 34. Loops 12 are sized to be smaller in circumference than the holding end (32) of the drumsticks, and loops 34 are sized to be smaller in circumference than the striking end (22) of the drumsticks. Thus both sets of loops 12 and 34 must deform to accommodate the drumsticks thereby creating a gripping force to hold the drumsticks against any accidental undesired withdrawal. FIG. 4 and FIG. 5 show the rows of loops 12 and 34 (FIG. 4) and the aspect when drumsticks 18 are inserted through the loops (FIG. 5).

Final assembly of the holster 16 is achieved by glueing together plates 2 and 4 with the loops 12 and 34 in place, as shown in FIG. 6. and FIG. 3. Glue is applied to the complete lower side 50 of upper plate 2 and to the complete upper side 52 of lower plate 4. This has the effect of glueing together not only plates 2 and 4, but also permanently fixing loops 12 and 34 because both surfaces of the ribbons 10 end up glued to the sandwich of plates as shown in FIG. 6.

Referring to FIG. 4, the entire Drumstick Holding Holster 16 is shown. In addition to the rows of loops 12 and 34, a pair of body straps 14 are in position, being pulled through body strap opening pairs 8 along the long parallel side 36 and the short parallel side 38.

Referring to FIG. 5, drumstick holding holster 16 is shown loaded with four drumsticks 18, each having a holding end or handle 32 and a striking end 22. The method of inserting a drumstick 18 consists of pushing it striking end 22 first through loop 12 and further through loop 34. Because each pair of corresponding loops 12 and 34 are offset as shown in FIG. 4 and the drumstick 18 is rigid, typically made of hardwood, the drumstick forces the elastic ribbon material of loops 12 and 34 to deform to grip drumstick 18 in a slant position as shown in FIG. 5. The loop pattern of FIG. 4 results in the radiating out storage pattern of FIG. 5, the drumsticks being separated from each other by an acute angle 20. With equal distances 24 and equal distances 26, where distances 24 are greater than distances 26, the angles 20 will all be the same. The result is is that with a predetermined adequately large angle 20 based on the dimensions of sides 36 and 38 and edges 40, 42 and 44, and the number and lengths of drumsticks 18, the separation of the holding ends 32 will be large enough to pull out speedily one chosen drumstick without disturbing or interference from an adjacent drumstick.

Referring to FIG. 6, a half-section through FIG. 5 is shown, indicating how the drumsticks 18 are gripped by the loops 12 due to the glueing together of plate 2, ribbon 10 and plate 4 to form fixed and permanent loops 12. Also shown is a body strap 14 threaded through openings 8. To withdraw a drumstick from storage, a normal pull, even by a small person, is sufficient to remove a drumstick against the grip of the deformed loops. After drumstick removal the loops again assume their normal undeformed shape and are ready to store another drumstick.

The principles of the invention just described in its preferred embodiments can be applied to related beaters of percussion instruments such as timpani sticks and mallets for marimba or xylophone. To accommodate geometrical differences in striking and holding ends and diameter and length of related beaters, loops 12 and loops 34 must be made larger or smaller as required, the geometry of the plates 2 and 4 must be adjusted in terms of the separation between parallel sides 36 and 38 and the dimensions of sides 36 and 38, and the placing of the two rows of slots 6. For very long beaters plates 2 and 4 may be lengthened and three rows of slots 6 may be cut in plates 2 and 4 to accommodate the longer beaters.

Figure 8:
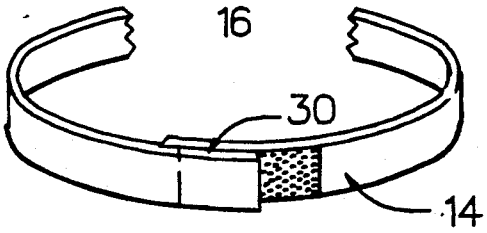
FIG. 8 is a pictorial view of a velcro body strap attachment means.
Figure 7:
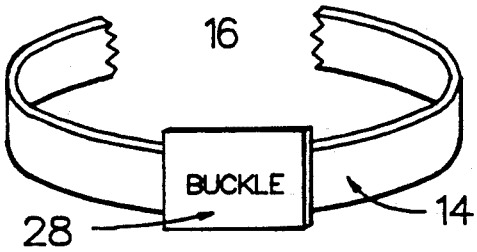
FIG. 7 is a pictorial view of a buckle as a body strap fastening means.

Referring to FIG. 7 and FIG. 8, two types of fastening means for strapping the drumstick holding holster to a part of the percussion player's body are shown. In FIG. 7 a buckle attachment arrangement 28 connects together the two ends of body strap 14 emanating from holster 16. In FIG. 8 a velcro attachment arrangement 30 connects together the two ends of body strap 14 emanating from holster 16. Other convenient fastening means may be employed to connect together the ends of body strap 14.

Figure 10:
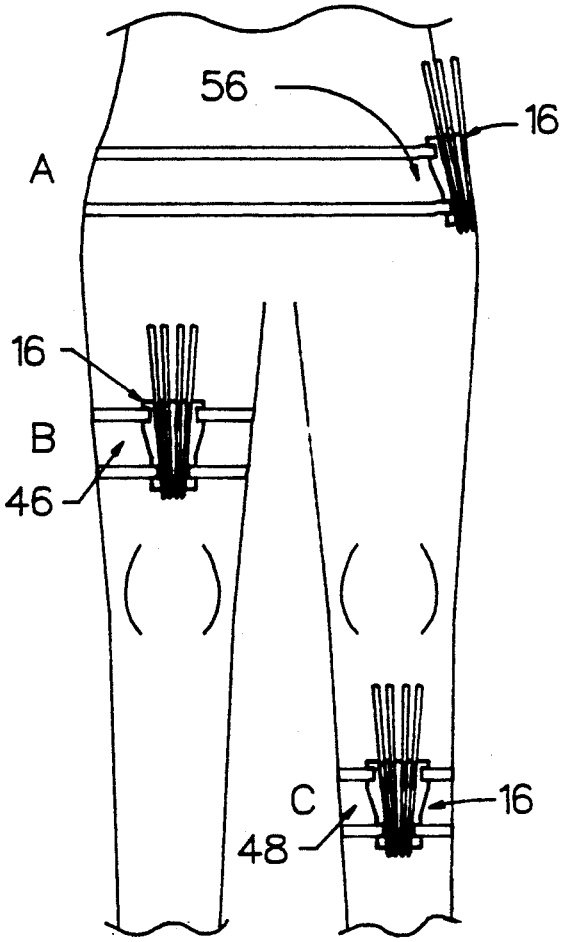
FIG. 10 is a pictorial view of the Drumstick Holding Holster attached to (A) the hips, (B) a thigh, and (C) a leg of the percussion player.
Figure 9:
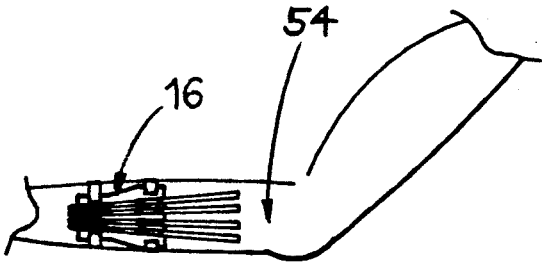
FIG. 9 is a pictorial view of the Drumstick Holding Holster attached to an arm of the percussion player.

Referring to FIG. 9 and FIG. 10, the attachment of the holster 16 to four different body parts of a percussion player are shown. In FIG. 9 an arm 54 is shown. In FIG. 10 are shown in one pictorial view (A) hips 56, (B) thigh 46, and (C) leg 48. The holster is for use by seated, standing and marching percussion players and may be attached to any other body part where convenient for access to withdraw the drumsticks or beaters. Also, two holsters may be worn at the same time by the percussion player, such as around both thighs or around the hips or waist.

By adding area to the basic functional holster, ornaments and insignia may be carried on the holster. Other realizations of the present invention are possible without departing from the spirit and scope of the invention as delineated in the appended claims.

I claim:

1. A holster for storing and dispensing a plurality of drumsticks, each drumstick having a striking end and a holding end, for use by a percussion player and attached to the percussion player's body, the holster comprising:

an upper plate of flexible plate material substantially in the shape of a trapezoid having a short side and a long side which are parallel to each other, perforated by (a) a first row of a plurality of equally closely-spaced elongated slots located along the short side with a longitudinal axis of said slots perpendicular to the short side, (b) a second row of a plurality of equally widely-spaced elongated slots located along the long side and the number of said slots equal to the number of slots of said first row, (c) a first pair of elongated body strap openings located adjacent to said first row of slots with the longitudinal axis of said body strap openings parallel to the longitudinal axis of the slots in said first row, and (d) a second pair of elongated body strap openings located adjacent to said second row of slots with the longitudinal axis of said body strap openings parallel to the longitudinal axis of the slots in said second row;

a lower plate of flexible plate material of the same trapezoidal shape and dimensions as the upper plate, perforated by (e) a third pair of elongated body strap openings identical in dimensions and location to said first pair of parallel elongated body strap openings in the upper plate, and (f) a fourth pair of elongated body strap openings identical in dimensions and location to said second pair of elongated body strap openings in the upper plate, so that when the upper plate and the lower plate are placed coincident one on top of the other said first pair of body strap openings in the upper plate exactly overlays said third pair of body strap openings in the lower plate, and said second pair of body strap openings in the upper plate exactly overlays said fourth pair of body strap openings in the lower plate;

a first flat elastic ribbon threaded continuously through said first row of elongated slots in the upper plate to form a row of equally closely-spaced loops extending upward from an upper side of the upper plate and designed to releasably grip the drumsticks near their striking ends;

a second flat elastic ribbon threaded continuously through said second row of elongated slots in the upper plate to form a row of equally widely-spaced loops extending upward from the upper side of the upper plate and designed to releasably grip the drumsticks near their holding ends, the holster assembly being constructed by glueing the upper side of the lower plate while exactly underlying the upper plate to a lower side of the upper plate and clamping portions of the threaded first flat elastic ribbon and second flat elastic ribbon between said upper and lower plates;

a first body strap of flat flexible strap material threaded through said overlaid first and third pair of body strap openings in the glued-together holster assembly with fastening means at the strap ends for strapping the holster to the percussion player; and a second body strap of flat flexible strap material threaded through said overlaid second and fourth pair of body strap openings in the glued-together holster assembly with fastening means at the strap ends for strapping the holster to the percussion player.

2. The holster of claim 1 where the flexible plate material is leather.

3. The holster of claim 1 where the elastic ribbon material is of knitted construction.

4. The holster of claim 1 where the flexible strap material is nylon.

5. The holster of claim 1 where the body strap fastening means are velcro attachments.

6. The holster of claim 1 where the body strap fastening means are buckles.

7. A method for storing and dispensing a plurality of drumsticks for use by a percussion player, making use of the holster of claim 1, comprising the steps of:

(a) inserting a drumstick into the holster by pushing the striking end of the drumstick first through a loop formed by said second ribbon and further through a corresponding loop formed by said first ribbon, resulting in the drumstick being releasably gripped in two places by two said loops, whereby the striking end of the drumstick protrudes beyond the loop formed by said first ribbon and the holding end of the drumstick projects from said two loops and is ready to be pulled from the holster;

(b) repeating the insertion step (a) above for the remaining drumsticks, each drumstick being releasably gripped in two places by corresponding loops in said first ribbon and said second ribbon, the stored drumsticks in the now fully loaded holster radiating out holding end first with an acute angle between each drumstick and adjacnet drumsticks so that the holding ends of the drumsticks are adequately separated from each other for convenient grasping when the percussion player needs to remove a drumstick from the holster;

(c) strapping the loaded holster to the percussion player by fastening the ends of the first body strap together around a part of the percussion player's body and fastening the ends of the second body strap together around said part of the percussion player's body;

(d) removing a drumstick from the holster as needed during a performance by grasping the holding end of the drumstick and pulling the drumstick out through two said corresponding loops for immediate use by the percussion player; and (e) repeating step (d) above as many times as needed until all drumsticks stored in the holster have been removed.

8. The method of claim 7 where the part of the percussion player's body is the hips.

9. The method of claim 7 where the part of the percussion player's body is a thigh.

10. The method of claim 7 where the part of the percussion player's body is a leg.

11. The method of claim 7 where the part of the percussion player's body is an arm.

* * * * *